United States Patent [19]

Crow

[11] 4,022,284

[45] May 10, 1977

[54] AUTOMATIC ALIGNMENT SYSTEM FOR EARTH BORING RIG

[75] Inventor: Morgan LeVon Crow, Dallas, Tex.

[73] Assignee: Dresser Industries, Inc., Dallas, Tex.

[22] Filed: Mar. 17, 1975

[21] Appl. No.: 558,872

[52] U.S. Cl. ..... 173/2; 33/366; 33/333; 175/24

[51] Int. Cl.[2] ..... E21B 7/02; E21B 7/04

[58] Field of Search ..... 175/40, 46, 45, 24; 299/1; 173/2, 4, 20; 33/406, 375, 333, 366

[56] References Cited

UNITED STATES PATENTS

| | | | |
|---|---|---|---|
| 1,884,728 | 10/1932 | Kiesel | 33/395 |
| 2,618,712 | 11/1952 | Moledzky | 33/366 X |
| 2,772,411 | 11/1956 | Cooper | 33/333 UX |
| 3,010,124 | 11/1961 | Postlewaite | 33/395 X |
| 3,400,771 | 9/1968 | Dorn | 173/20 X |
| 3,437,377 | 4/1969 | Lautsch | 299/1 |
| 3,497,950 | 3/1970 | Squire et al. | 33/366 |
| 3,550,959 | 12/1970 | Alford | 299/1 |
| 3,695,369 | 10/1972 | Drouet | 175/45 |
| 3,721,304 | 3/1973 | Hanson | 173/2 |
| 3,724,559 | 4/1973 | Stromnes | 173/4 |
| 3,854,775 | 12/1974 | Anderson | 299/1 |
| 3,865,265 | 1/1975 | Brudi et al. | 33/366 X |

FOREIGN PATENTS OR APPLICATIONS

| | | | |
|---|---|---|---|
| 768,365 | 10/1967 | Canada | 33/366 |

*Primary Examiner*—Ernest R. Purser
*Assistant Examiner*—William F. Pate III
*Attorney, Agent, or Firm*—Michael J. Caddell

[57] ABSTRACT

An automatic alignment control system for an earth boring rig utilizes sensor means on the drilling mast for actuating switches connected to power controls. The sensor means reacts to misalignment of the drilling mast vertical axes to close appropriate switches which in turn generate signals to power means which are arranged to shift the mast axes in the appropriate direction for proper vertical alignment.

5 Claims, 17 Drawing Figures

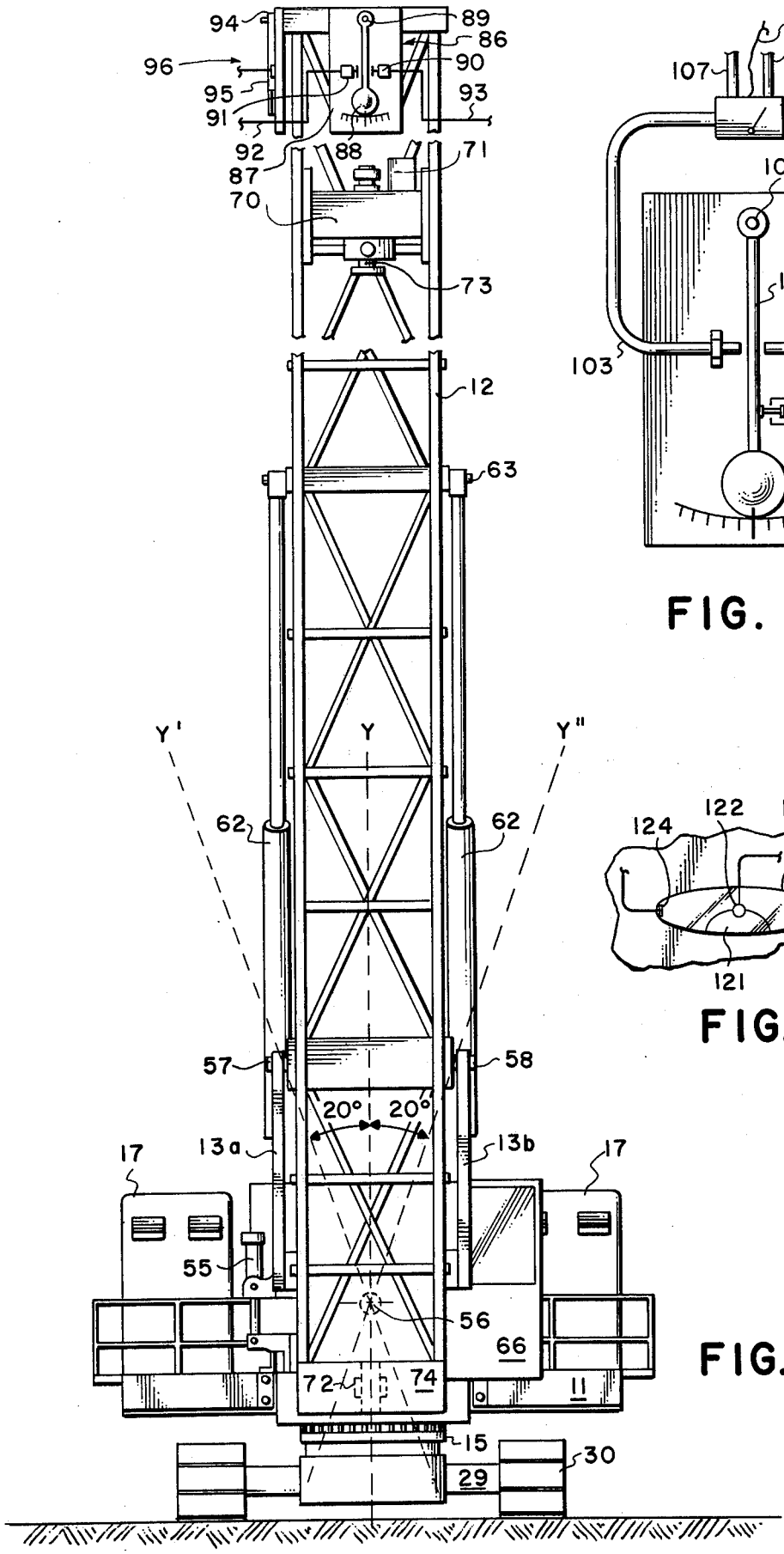
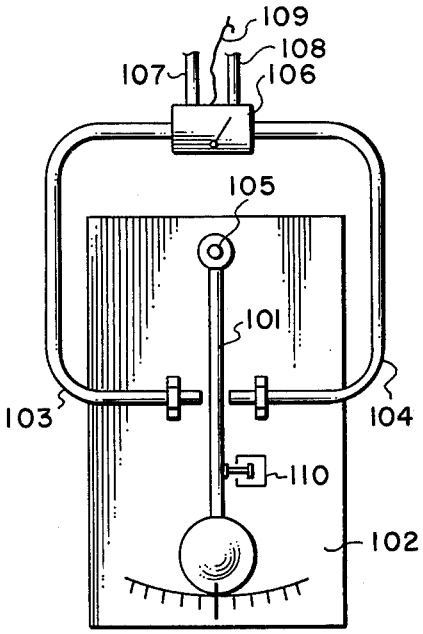
FIG. 12
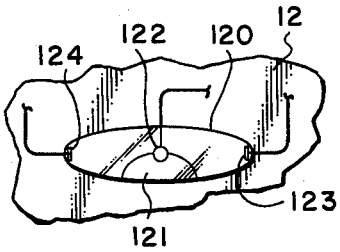
FIG. 13
FIG. 3

AUTOMATIC ALIGNMENT SYSTEM FOR EARTH BORING RIG

BACKGROUND OF THE INVENTION

In the boring of vertical and non-vertical holes in the earth for the placement of support structures such as pilings, the common practice is to use vertical power driven augers to bore into the earth formation. These augers are usually rotatably suspended from a drilling mast attached to the rear of a truck. A serious disadvantage to the auger system is its inability to accurately bore piling holes in sloping and uneven grounds. For instance, in the building of bridges and other sophisticated projects such as the Alaskan pipeline project, piling support holes must be drilled through the ground in rough terrain while maintaining a vertical accuracy of three inches in a borehole fifty feet deep. Also as in the case of the Alaskan pipeline, the boreholes must be drilled with a minimum amount of damage to the earth formation being penetrated. For instance, when the holes are drilled in tundra and frozen ground, extreme care must be taken to prevent thawing of the ground surrounding the borehole and care must be taken to prevent scarring of the surface of the tundra by the drilling vehicle.

The present state of auger drilling does not provide nearly enough accuracy to drill within three inches in a fifty foot deep borehole. Furthermore, the auger type of drill is very damaging to the formation and the tundra in that it thaws the tundra and must also be removed very frequently to remove cuttings which accumulate within the auger flutes.

The present invention overcomes these difficulties by providing a portable rig system rotatably mounted on a tracked vehicle having automatic power alignment means for obtaining extremely accurate alignment of the drill and mast over the boring site.

BRIEF DESCRIPTION OF THE DRAWINGS

FIG. 3 is an end view of the apparatus of FIG. 1 also showing the mast in an elevated position.

FIG. 12 is a close-up schematic view of one embodiment of the sensor means and switch means on a drilling system.

FIGS. 13–17 are close-up schematic views of alternate embodiments of sensing means and switch means on a drilling rig.

DESCRIPTION OF THE PREFERRED EMBODIMENTS

Figure 1:
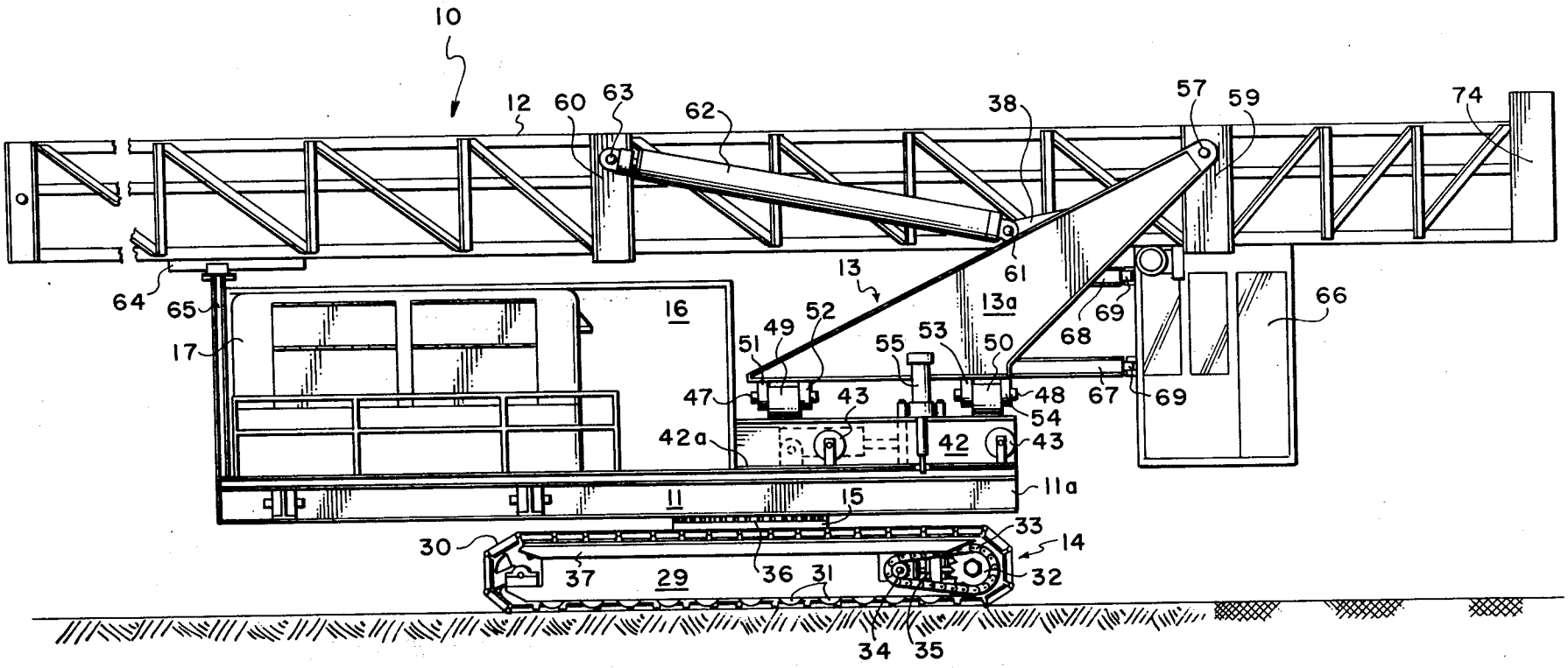
FIG. 1 is a side elevation view of the portable rig system mounted on the tracked vehicle.
Figure 2:
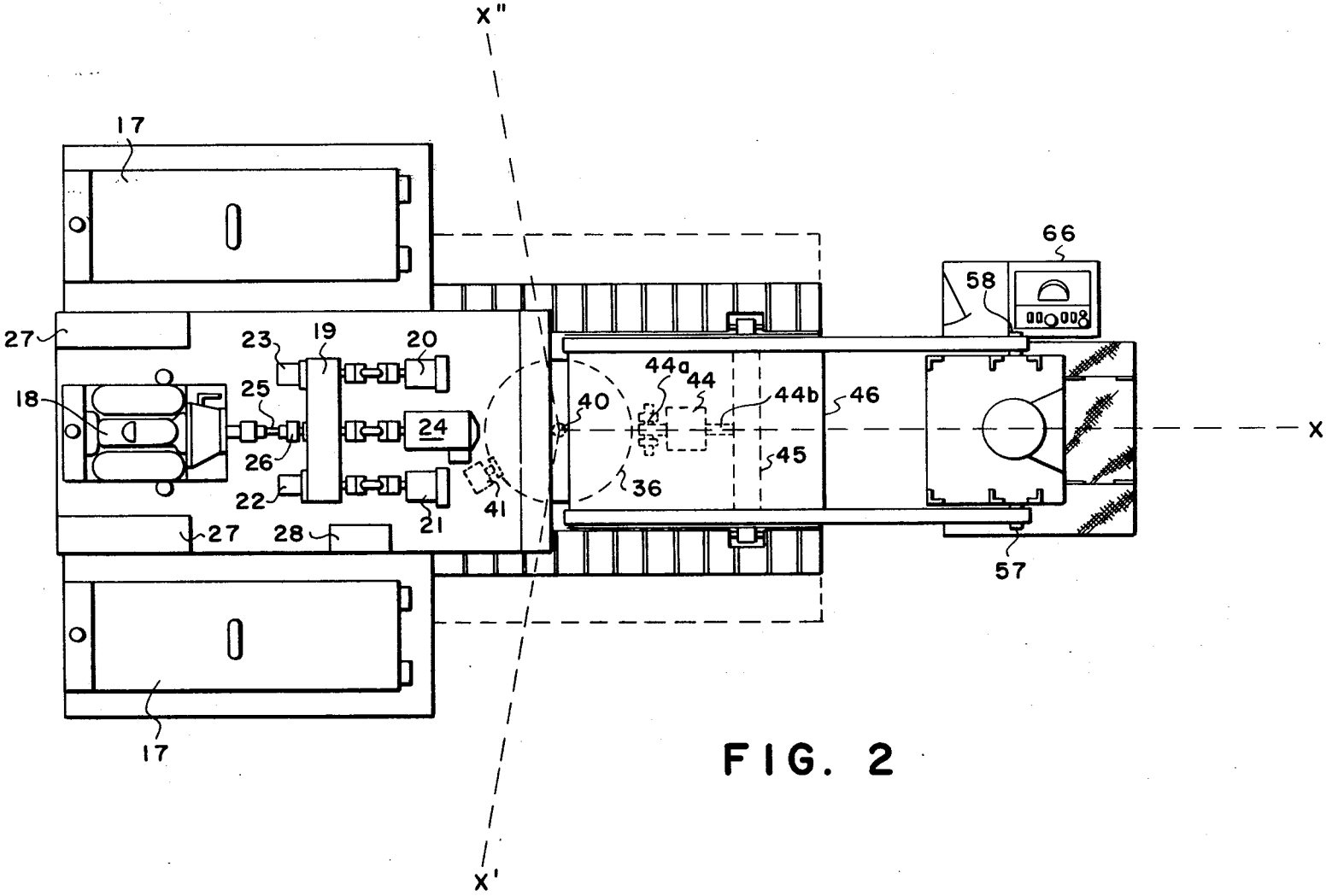
FIG. 2 is a top view of the apparatus of FIG. 1 showing the mast in an elevated position.

Referring now to FIGS. 1 through 3, the portable drilling system 10 is illustrated in side view and consists of a main chassis 11, a hinged movable drilling mast 12 mounted pivotably on chassis 11 by means of support arms 13. Chassis 11 is rotatably mounted on tracked vehicle 14 by means of a rotating table 15. A power shed 16 is mounted on chassis 11 between dual drilling air compressors 17. Shed 16 contains a prime mover such as a diesel engine 18 which drives through gear box 19 the main hydraulic pumps 20 and 21, auxiliary hydraulic pumps 22, 23, and electrical generator 24.

In FIG. 2, prime mover 18 is operably connected to gear box 19, hydraulic pumps 20 and 21, and generator 24 by means of drive shafts 25 and flexible couplings 26. Also located within shed 16 are hydraulic oil storage tanks 27 and a control panel 28. Tracked vehicle 14 comprises a main frame 29 around which is mounted a pair of endless tracks 30 suspended on plurality of rollers 31 set in frame 29. A drive gear 32 operably connected to tracks 30 is driven by means such as a belt or chain 33 which in turn engages a driving sprocket 34 mounted on a drive motor 35 which may be hydraulic, electric, or other known drive means. Preferably, drive motor 35 will be of the hydraulic type and will be connected to one of the main hydraulic pumps 20 or 21 through appropriate control systems.

Main frame 29 has attached at the top thereof a top plate 37 extending across frame 29 between tracks 30. A ring gear 36 is secured to the top of top plate 37 substantially near the center thereof and has external gear teeth peripherally mounted thereon. A motor (not shown) is attached to main chassis 11 and contains a gear in mesh with ring gear 36. The motor preferably is a hydraulic motor operably connected to one of the main hydraulic pumps 20 or 21 through appropriate control systems such as control panel 28. When hydraulic power is supplied to the motor, the motor operating in conjuction with ring gear 36 serves to rotate the main chassis about the tracked vehicle 14 as described with respect to FIG. 2 herebelow.

In FIG. 2, a center of rotation 40 is shown located substantially in the center of ring gear 36 shown in phantom. The drive motor 41 (shown in phantom) engages the ring gear 36 to swing the main chassis 11 about on the tracked vehicle. The center line axis of the main chassis is denoted at X. Movement of the main chassis on the tracked vehicle occurs within the range indicated by the movement of the X axis to the X′ axis of the X″ axis. This includes an arc of approximately 200° about center point 40.

Main chassis 11 has an extended front portion 11*a* upon which is slidably mounted an auxiliary chassis 42 having a pair of frontward extending longitudinal members of which one is shown in the side view of FIG. 1. One or more crossmembers extend transversally between the two frontward extending longitudinal members to provide structural integrity for the auxiliary chassis. A pair of rollers 43 are located at each side of the longitudinal members to provide guidance and alignment and prevent the auxiliary chassis from disengaging from the main chassis. The longitudinal side members of auxiliary chassis 42 preferably comprise I beams having upper and lower webs extending outward therefrom. The rollers 43 engage the lower web 42*a* of the I members to provide alignment and guidance.

Referring to FIG. 2 again, a power cylinder 44 is shown in phantom connected to a crossmember 45 of auxiliary chassis 44 by connection at 44*b*. Power cylinder 44 is also connected at 44*a* to main chassis 11. The function of power cylinder 44 is to provide lateral extension of auxiliary chassis 42 along main chassis portion 11*a*. Power cylinder 44 preferably is actuated by pressurized hydraulic fluid supplied by the main hydraulic pumps 20 and 21.

The support arm structure is comprised of a pair of upwardly and outwardly extending support arms 13 fixedly mounted upon a base plate 46 extending generally across and parallel to auxiliary chassis 42. Base plate 46 is pivotally mounted atop auxiliary chassis 42 by means of hinge pins 47 and 48. Hinge pins 47 and 48 are coaxially aligned along a line 56 (FIG. 3) substantially parallel to the central axis of base plate 46, which in turn is generally centrally located between longitudinal support members of auxiliary chassis 12.

Two upwardly extending pin mountings 49 and 50 are mounted atop auxiliary chassis 42. Pin mountings 49 and 50 have generally centrally located pin bores therethrough for receiving hinge pins 47 and 48. Downwardly extending pin lugs 51 through 54 are attached at the bottom of base plate 46 and located for alignment about mountings 49 and 50. Lugs 51 through 54 have pin bores therethrough for alignment with pin bores in mountings 49 and 50. Pins 47 and 48 pass through the pin bores of the downward extending lugs and the upward extending mountings to provide a hinged attachment of support structure 13 on auxiliary chassis 42.

A pair of vertical adjustment power cylinders 55 are fixedly secured at the lower end to auxiliary chassis 42 and at their upward end to the side of support arms 13. Power cylinders 55 preferably are hydraulic actuated by means of power fluid from main hydraulic pumps 20 and 21. The cylinders 55 are oriented in reverse acting sequence so that as one extends the other contracts. Thus, power cylinders 55 may be coacted simultaneously to provide a controlled rotation of support structure 13 about the center line 56 passing through hinge pins 47 and 48. Control of the pressurized power fluid to cylinders 55 preferably is located in control panel 28 or may be located at any advantageous point upon the apparatus.

The center line of rotation through hinge pins 47 and 48 appears in FIG. 3 as a center point of rotation 56. A vertical axis Y passing through center point 56 coincides generally with the vertical axis of mast structure 12. Controlled rotation of mast structure 12 about rotational axis 56 is possible up to approximately 20 degrees on either side of axis Y. The extent of rotation of axis Y is denoted by axes Y′ and Y″, each being approximately 20 degrees rotated from axis Y. It should be noted that the top view of FIG. 2 illustrates the apparatus with the mast structure removed.

Referring again to FIG. 1, the mast structure 12 is shown attached to support arms 13*a* and 13*b* by a pair of hinge pins 57 and 58 passing through support arms 13*a* and 13*b* and into mast side braces 59. A pin lug 60 is attached to the top of each of the support arms 13 and receives therein a hinge pin 61 to which is attached a mast raising cylinder 62 one on each side of the mast structure attached to each of the support arms. Cylinders 62 are pinned to an upper mast brace 60 by hinge pins 63. Cylinders 62 are actuated by pressurized hydraulic fluid from the main hydraulic pumps 20 and 21. Control of cylinder 62 is obtained by controlling the supply of power fluid passing through a control panel.

A headrest support 64 attached to vertical support members 65 which are themselves secured to the main chassis 11, provides a forward support table for vertical mast 12 when it is in the lowered position. A control cabin 66 is attached to extended arms 67 and 68 by means of hinges 69. Cabin 66 preferably is offset from the center of the apparatus a sufficient distance to allow raising and lowering of the mast without interference of the cabin. Cabin 66 is provided in the vicinity of the mast vertical axis Y so that operating personnel may be in very close proximity to the drilling site during the drilling operation. Attachment of cabin 66 by hinge pins 69 to forward extending arms 67 and 68 allows the cabin to be swung in during transit of the apparatus and allows it to be swung out to lower the mast over the drilling site after the mast has been raised to the vertical position. Cabin 66 preferably is provided with the appropriate control panels containing hydraulic control systems for operating the various power cylinders, the driven track 14, the rotating ring 15, and the associated power drilling systems to be hereinafter described.

Referring now to FIG. 3, an end view is disclosed illustrating the apparatus with the mast in a vertical position. In this view can clearly be seen the sliding rotary drive head 70 which applies rotary drilling force to the drill string (not shown) and further arranged to apply downward force or weight on the drill string. Rotary force is provided on the drill string by means of an hydraulically actuated motor 71 connected by means of fluid lines to the main hydraulic pumps 20 and 21. Control of the fluid to motor 71 is obtained by running the fluid lines through a control system within cabin 66. Drive head 70 is slidably mounted in the mast on tracks or guides to allow upward and downward movement in the drilling mast as the drill string bores into the earth and is brought out of the borehole after completion of the job. Downward force is applied to the drill string by means of a pull chain (not shown) mounted over the drive head and connected by means of sprockets to a pull weight drive motor located on the main chassis 11 or possibly on the auxiliary chassis 42. Operation of the pull weight motor preferably is hydraulic through control panels in cabin 66 by means of hydraulic pumps 20 and 21.

At the bottom of mast 12 is located a base structure 71 containing a bushing or rotating bearing 72 to provide rotatable support for the drill string. Rotary drive head 70 further has a drill string attachment means 73 for securing the drill string into the rotary drive head. The attachment means 73 preferably is rotatably supported in drive head 70 by means such as roller bearings.

Referring again to FIG. 3 and to FIGS. 12 and 13, automatic rig alignment systems 86 and 96 are illustrated for providing continuous automatic vertical alignment of the drilling mast.

System 86 comprises a vertical mounting plate 87 secured to the upper portion of the drilling mast 12, with a damped pendulum 88 pivotally suspended from plate 87 by means of pivot pin 89. Right- and left-hand microswitches 90 and 91 are secured to plate 87 in close proximity to pendulum 88, one at each side thereof. Each of the microswitches is arranged to be actuated by lateral movement of the pendulum in one direction or the other caused by the mast not being in proper vertical alignment. For instance, if the mast has a leftward inclination greater than the maximum allowable amount, the left microswitch 91 will be contacted by pendulum 88.

Actuation of switch 91 sends a signal via conduit 92 to the control panel 28 or equivalent control system in cabin 66 whereby the power cylinders 55 are actuated in complementary fashion, as previously described, to apply a realigning movement of the mast until switch 91 is no longer contacted by pendulum 88. A conduit 93 leads from switch 90 to the same control system.

A damping system such as a dashpot can be utilized on pendulum 88 to prevent harmonic oscillation of the pendulum during operation of the alignment system.

A similar system 96 is provided on the side of mast 12 at an orientation rotated 90° from system 86 to provide continuous automatic control of the mast alignment in the front-to-back plane of movement.

System 96 utilizes a pendulum 95 pivotally mounted on a plate 94 and having switch means at both sides of the pendulum for sending adjustment signals via power control panel means to the front-to-back alignment power cylinders 62. Operation of system 96 on cylinders 62 is analogous to that of system 86 and cylinders 55.

Thus, for instance, if the mast is tilted too far away from the rig, one switch of system 96 will be actuated by pendulum 95 and cylinders 62 will both be activated into the retraction mode to pull the mast back toward the rig until vertical alignment is reached as signified by deactivation of the microswitch.

FIG. 12 schematically illustrates another type of alignment system which could be used in place of systems 86 and 96. In FIG. 12, a damped pendulum 101 is pivotally mounted at pin 105 on a plate 102. A pressure jet 103 is mounted on plate 102 to one side of pendulum 101 and a second jet 104 is attached to the plate at the other side of the pendulum. Jets 103 and 104 are arranged to direct jets of air directly at the sides of the pendulum. The jets are conduit tubes fluidically connected to a pressure differential switch 106 having pressurized air supply tubes 107 and 108 also connected thereto. A signal conduit 109 also is connected to switch 106 and leads to one or the other sets of power cylinders 55 or 62. A damping device, such as a dashpot 110, is connected to pendulum 101 and plate 102 to damp out undesirable oscillations of the pendulum.

The operation of the embodiment of FIG. 12 involves emitting a pair of equal continuous streams of jetted fluid such as compressed air out of jets 103 and 104 against pendulum 101. As the vertical axis of mast 12 changes, pendulum 101 will move toward one of the jets and away from the other. The air pressure in the closer jet will increase and a similar decrease in the opposite jet will occur. This difference in pressure will be sensed by the pressure differential switch 106 which will generate a signal to conduit 109 which signal will actuate the controls to the appropriate power cylinder for realignment of the mast.

In FIG. 13, an electrical mercury switch is disclosed having a sealed bubble 120 containing a drop of liquid conductor 121 such as mercury. A common lead 122 penetrates the bubble near the center thereof and maintains contact with the liquid conductor. Right and left-hand leads 123 and 124 respectively penetrate each end of the bubble. All of the leads are sealed in the bubble wall in fluid-tight contact. In a level orientation, neither the right nor the left-hand leads are in contact with fluid conductor. Two or more bubbles 120 are mounted securely on a portion of the mast 12 so that when the mast is in perfect or nearly perfect vertical alignment, the bubbles will be in level orientation. When the mast is moved out of alignment, the liquid conductor will flow into contact with one of the side leads 123 or 124 and electrical contact is made between central lead 121 and the side lead. A signal is generated down the side lead from the common lead, which signal actuates the control system needed to realign the mast as previously described.

OPERATION OF THE PREFERRED EMBODIMENTS

The present invention is particularly suitable for the drilling of boreholes for the placement of support pilings in the construction of the proposed Alaskan pipeline. The drilling apparatus 10 may be transported to the drilling site by means such as trucking or transport aircraft. The invention is assembled on a work pad 80 which has been constructed prior to the location of the drilling apparatus 10 at the site. It is contemplated that work pad 80 will be constructed along the pipeline route prior to the building of the pipeline itself and will resemble a roadway having a substantially flat work surface thereon.

The present invention is particularly suitable for movement along this work surface and for the drilling and placement of the boreholes for the piling supports at the exact desired locations on and around the work pad. Motivation of apparatus 10 is provided by the actuation of endless tracks 30 about the main frame 29 by means of the hydraulic or electric motors 35. In one particular embodiment of the invention, the tracked vehicle moves along the work bed at the rate of approximately 130 feet per minute. As the drilling apparatus 10 approaches the boring sites, the various adjustment and alignment systems within the drilling apparatus 10 are activated to provide the exact desired location of the bore-hole and the almost perfect vertical placement of the hole into the ground.

Figure 4:
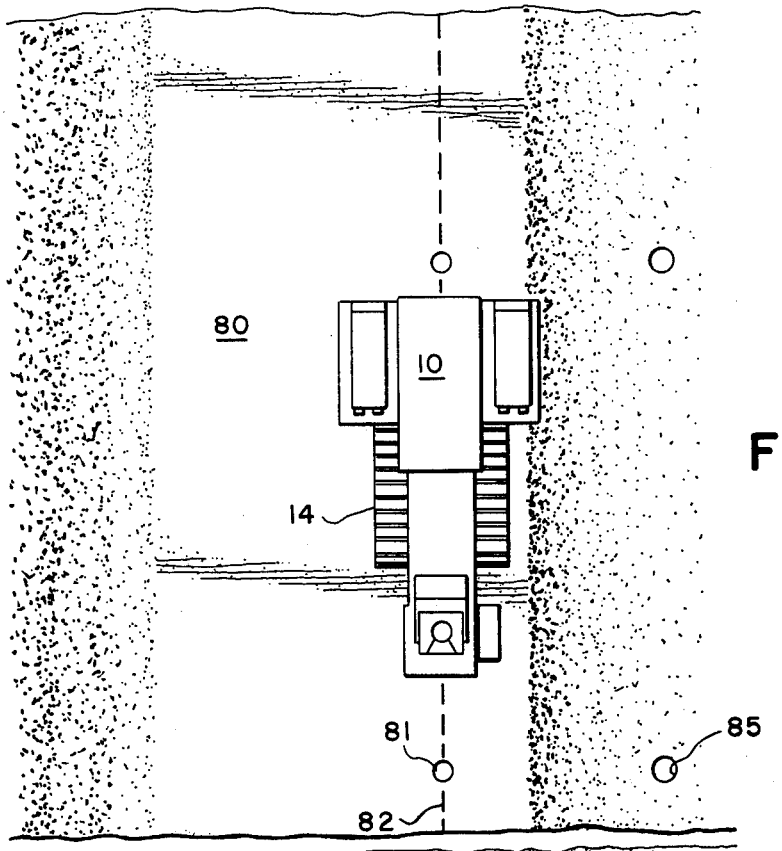
FIG. 4 is a top schematic view of the drilling apparatus oriented in the direction of movement along the work pad.

Movement of the vehicle on the endless tracks may be either forward or backward as desired by the operator. Referring now to FIG. 4, the drilling apparatus 10 is shown in schematic on the work pad 80 with the longitudinal axis of the vehicle coinciding with the direction of the work pad 80. Various borehole sites are noted at 81 and movement of the drilling apparatus in FIG. 4 along the work pad 80 along the dotted line 82 places the drilling apparatus in position to drill these holes.

Figure 5:
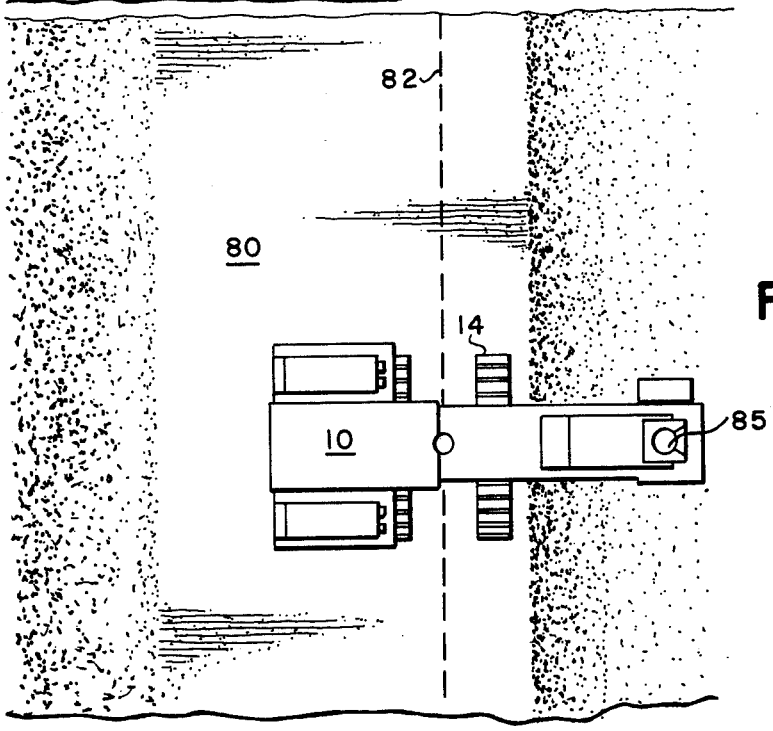
FIG. 5 illustrates a top schematic view of the same apparatus rotated transversely to the line of travel.

FIG. 5 illustrates how the drilling apparatus may be rotated about ring 15 to provide placement of the drilling mast over a borehole site 82 located off of the line of movement to the side of the work pad. It should be noted that the endless tracks 30 maintain substantially parallel alignment with the longitudinal direction of work pad 80. This allows a considerable saving in time and effort in that the vehicle can continue on in straight line movement while allowing the drilling portion to rotate about to either side to provide drilling of the holes along the sides of the work pads as well as holes along the line of movement of the drilling apparatus 10.

Figure 6:
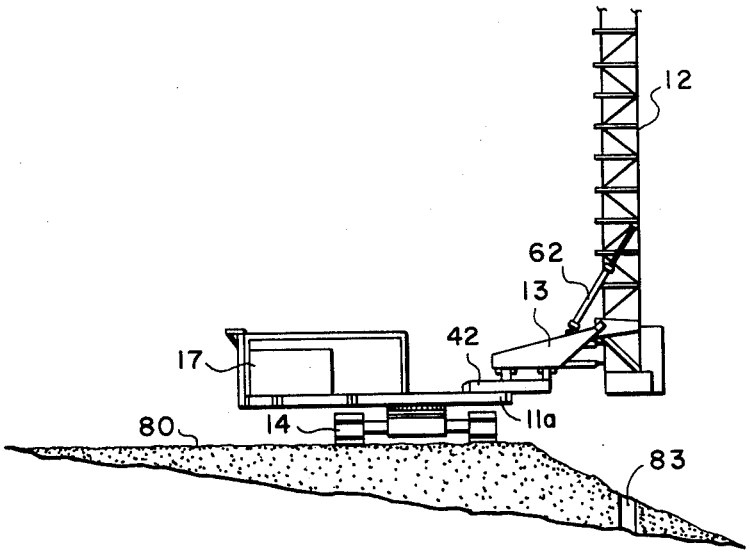
FIGS. 6 through 9 illustrate various orientations of the apparatus to obtain desired borehole locations around the work pad.
Figure 7:
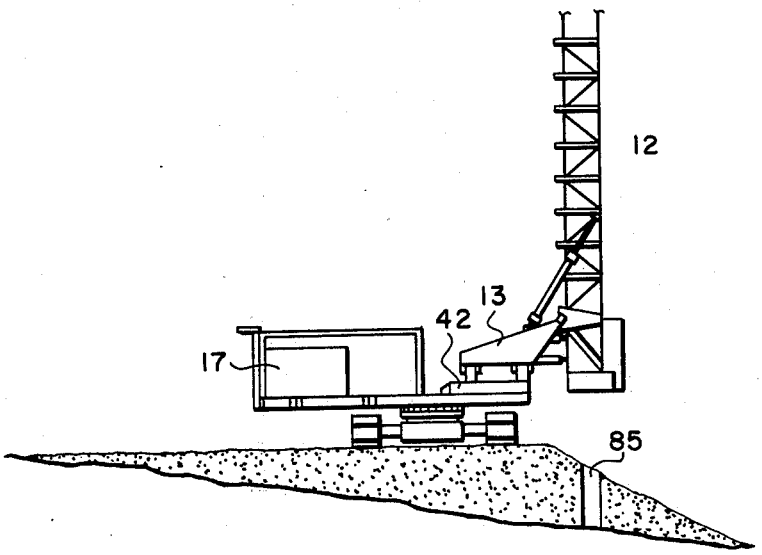

Whereas FIGS. 4 and 5 are top schematic views of the drilling vehicle, FIGS. 6 through 9 illustrate front schematic views of the vehicle taken at the level of the work pad 80. In FIGS. 6 and 7, the extension of auxiliary chassis 42 is shown to illustrate versatility of the drilling apparatus in drilling bore-holes to the side of the apparatus.

In FIG. 7, a borehole located fairly close to the drilling apparatus can be drilled by retracting the power cylinder 44 to the point where the auxiliary chassis 42 lies substantially on main chassis 11*a*.

In FIG. 6, a borehole site a substantially longer distance from the drilling apparatus may be reached by activating power cylinder 44 into expansion and sliding auxiliary chassis 42 outward along main chassis 11*a* until the drilling mast is located directly over the drilling site 83.

Figure 8:
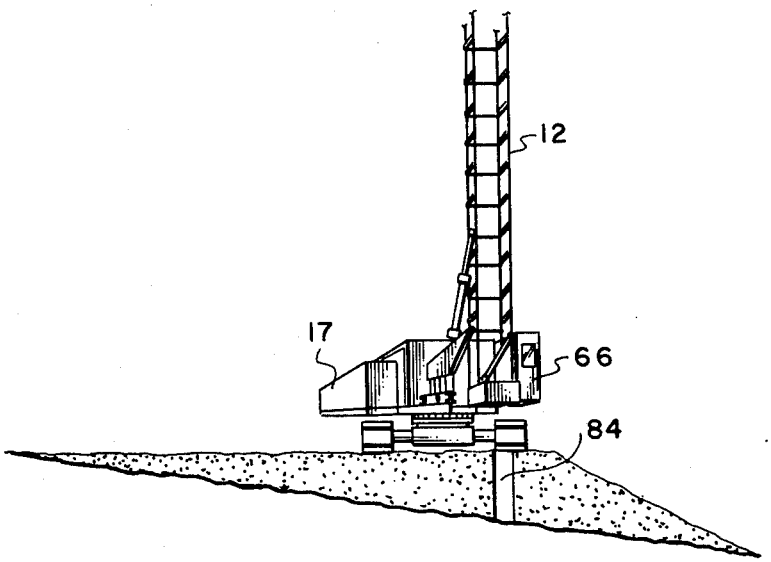

FIG. 8 illustrates operation of the turning apparatus on ring 15 to drill a borehole 84 in a site only slightly off the center line of the drilling apparatus.

Figure 9:
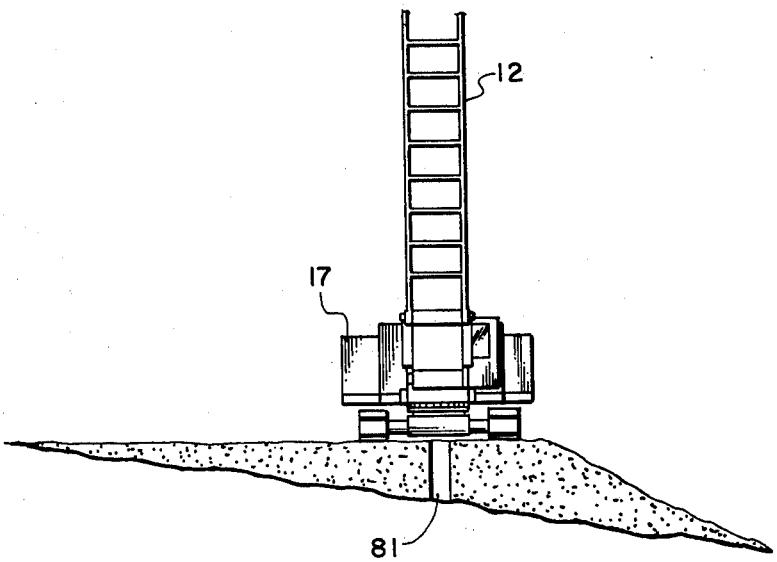
Figure 10:
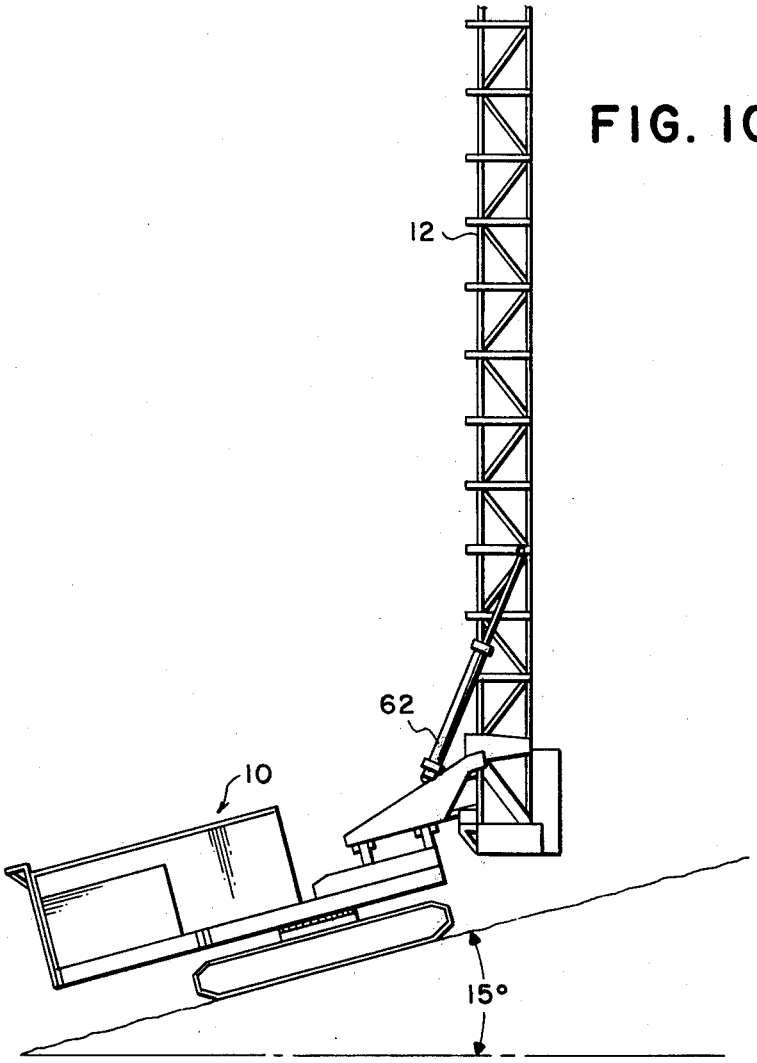
FIG. 10 is a schematic illustration showing alignment of the rig on an up-slope.
Figure 11:
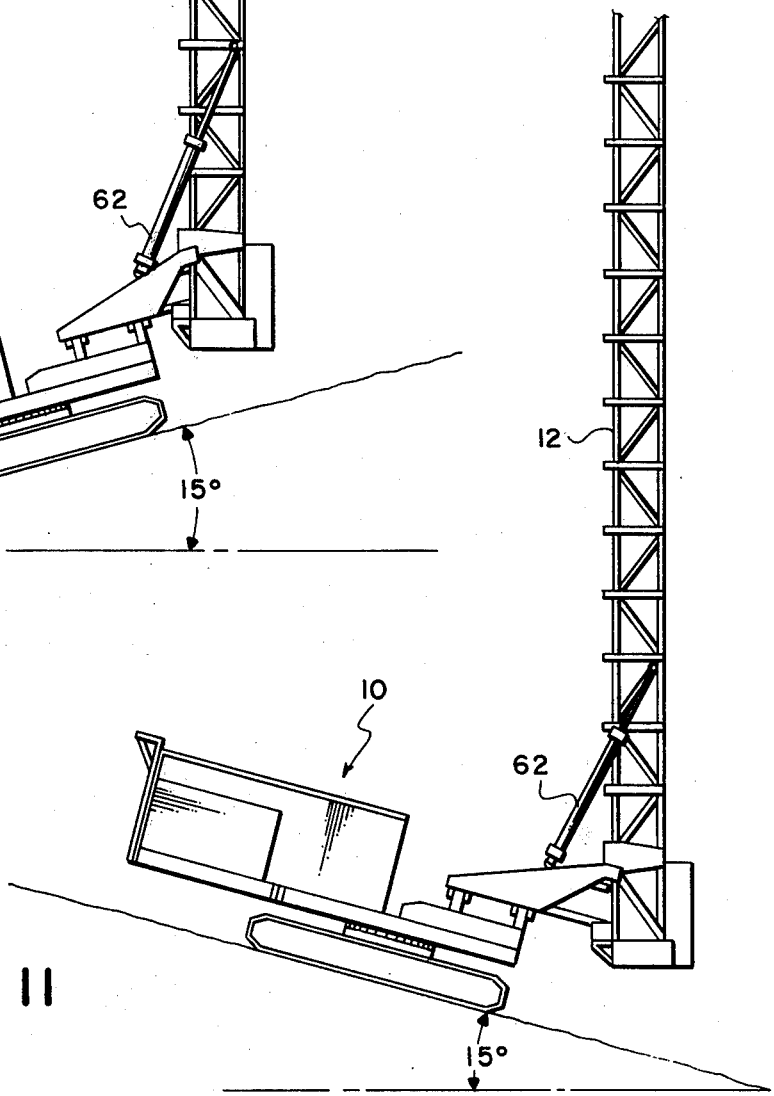
FIG. 11 is a schematic showing alignment of the rig on a down-slope.

FIG. 9 illustrates the drilling of a borehole 81 lying directly along the apparatus center line which is also the line of direction of movement of the aparatus. FIGS. 10 and 11 illustrate operation of the drilling apparatus when the vehicle is located on a slope and it is desirable to obtain perfectly vertical boreholes on the slope. In FIG. 10, the drilling apparatus is operating on an approximately 15 degree up-slope with the mast positioned in a perfectly vertical orientation through actuation of vertical alignment cylinders 62. FIG. 11 shows the operation of the apparatus on a 15 degree downslope with perfect vertical alignment of the mast 12 once again obtained through manipulation of the power cylinders 62.

In the automatic alignment of the mast during operations on the slopes illustrated in FIGS. 10 and 11, the mast side system 96 or other disclosed alignment system located similarly to system 96, has actuated cylinders 62 during movement of the rig onto the slope to maintain the desired mast vertical alignment. By the time the boring rig 10 has been properly located over the drill site, the mast will be in vertical alignment within the acceptable margin of error.

Thus, it can be seen that there are sufficient alignment systems to provide infinite flexibility in the placement of the borehole in the drilling site while allowing the motivating system on the drilling apparatus to remain aligned with the direction of movement of the drilling system. For instance, front to back adjustment of the mast on the drilling apparatus is obtained through the actuation of cylinder 44 moving auxiliary chassis 42 on main chassis 11*a*.

A rotation of the drilling mast in the lateral plane is obtained by the movement of the drilling apparatus on gear 15 with respect to the tracked vehicle 14. Left to right vertical alignment about the center line 56 is obtained by the simultaneous actuation of cylinders 55. Front to back vertical alignment of the mast is obtained by the actuation of cylinders 62. Thus, with this apparatus, location of the borehole at the exactly desired drilling position is obtainable within an error of less than three inches from the surveyed point.

Furthermore, drilling accuracy top to bottom, of a fifty foot borehole is obtainable with a drilling error of less than 1/2 of 1 percent. In operation, the drilling system utilized with this drilling apparatus is a vacuum drilling system such as that disclosed in U.S. Pat. Application Ser. Nos. 517,708, 517,720 and 517,661 assigned to the assignee of this invention. In those applications, a process for vacuum drilling is described utilizing a double wall drilling pipe having an induced vacuum in one area of the drilling pipe and a compressed air moving through the other area of the drilling pipe, both combined to carry away cuttings from the interface of the drill with the formation. Operation of this system depends upon having an abundant supply of compressed air, which supply is provided by the drilling air compressors 17 located on the drilling apparatus 10.

OTHER ALTERNATE EMBODIMENTS

Figure 14:
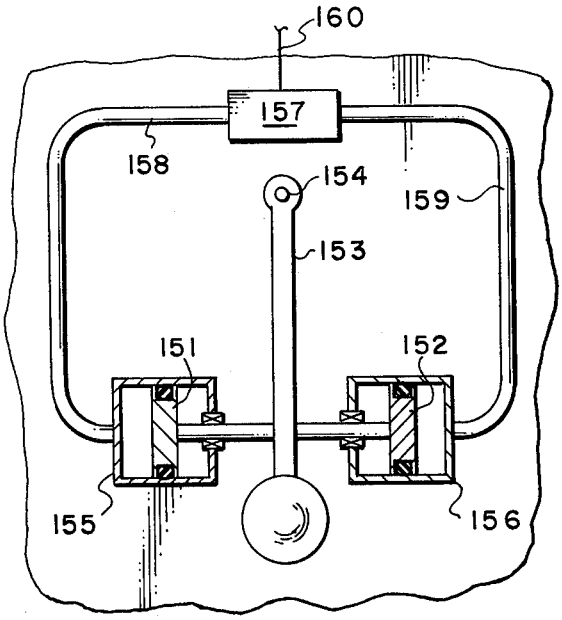

FIGS. 14 through 17 are schematic illustrations of alternate sensing means for use with the present invention. In FIG. 14, a pair of hydraulic pistons 151 and 152 are secured by means of piston rods to the sides of a pendulum 153, which pendulum is pivotally attached to the vertical structure at pin 154. Pistons 151 and 152 are each sealingly and slidably mounted in respective cylinders 155 and 156 which contain hydraulic fluid. The cylinders 155 and 156 are in fluidic communicationwith a pressure switch 157 via conduits 158 and 159, which switch is adapted to measure pressure variations in the cylinders and generate signals proportional thereto which signals are communicated via signal conduit 160 to the control panel through which the appropriate mast power cylinders are controlled.

Figure 15:
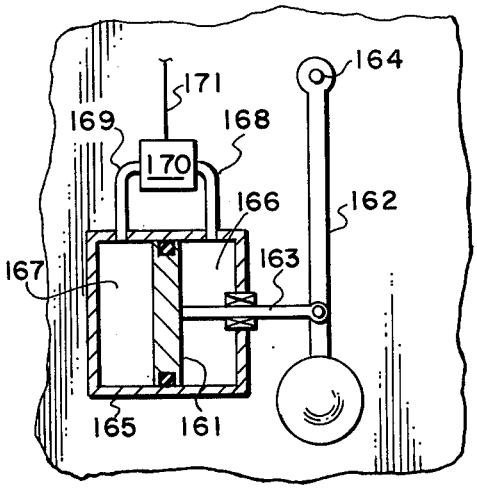

FIG. 15 illustrates in schematic diagram another hydraulic piston and cylinder assembly for sensing vertical misalignment and generating signals responsive thereto. In this embodiment, a single hydraulic piston 161 is attached to a pendulum 162 by means of a connecting rod 163. Pendulum 162 is pivotally attached at 164 to the mast structure. Piston 161 is sealingly and slidably engaged in an hydraulic cylinder 165 and divides cylinder 165 into left and right-hand pressure chambers 166 and 167 which may be filled with hydraulic fluid. Pressure conduits 168 and 169 communicate chambers 166 and 167, respectively, with a differential pressure switch 170 which generates signals along conduit 171 proportional to the pressures in chambers 166 and 167. Alternatively, a separate pressure switch with separate signal lead could be attached to each of the conduits 168 and 169.

Figure 16:
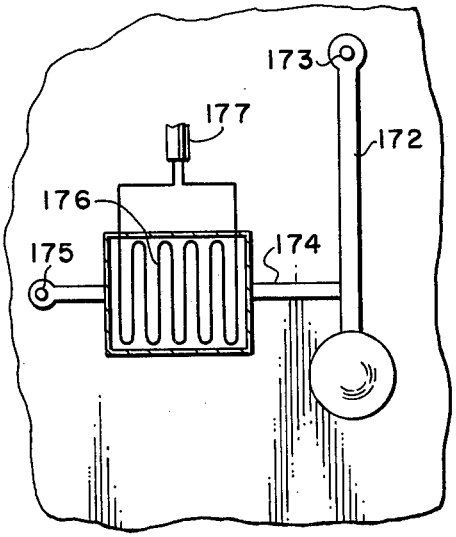

FIG. 16 illustrates another sensing means utilizing a pendulum means 172 pivotally attached to the vertical structure at pin 173. A signal rod 174 is secured to the pendulum and to the vertical structure at 175. The rod 174 contains thereon a typical strain gauge 176 arranged to measure axial compression and tension forces in rod 174 generated by the action of pendulum 172 thereon when the vertical structure is out of vertical alignment.

A signal lead 177 leads from the strain gauge 176 to appropriate controls associated with the mast actuating power cylinders. Alternately, a weak source of electric power may be applied across the strain gauge and changes in voltage measured to determine the strain generated therein by the movement of the pendulum.

Figure 17:
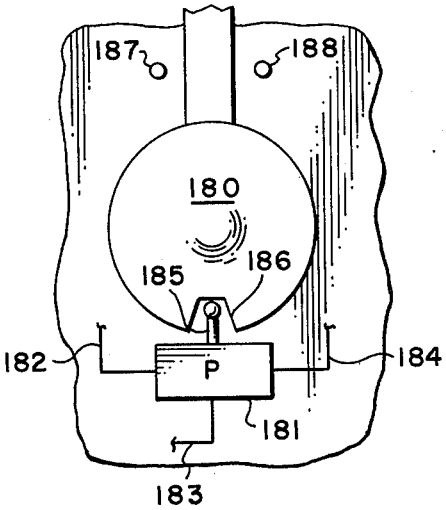

FIG. 17 illustrates a potentiometer sensing system in which a pendulum 180 pivotally mounted on the vertical structure has located closely therebelow a potentiometer 181. Power input leads 182 and 183 and signal output lead 184 are operably connected thereto. A sliding contact arm 185 for varying the potential across the potentiometer extends vertically upward from a slot in the top of the potentiometer housing. The output of the potentiometer depends directly upon the lateral position of slide arm 185. A recess 186 in pendulum 180 is arranged to receive arm 185 in engagement therein so that swinging of the pendulum in response to misalignment of the structure's vertical axis will result in movement of the slide arm and varying of the potentiometer output. The varied signal is communicated via conduit 184 to appropriate control panel means operably connected to the mast power cylinders.

A pair of stop pins 187 and 188 may be provided one at each side of the pendulum to prevent over extension of the pendulum past the range of sliding arm 185.

As an alternative to using the position of a movable weight, such as a pendulum to vary an electrical potential, other parameters could be varied by the movement of a pivoted weight. For instance, capacitance could be utilized as a parameter. Likewise, magnetic flux or a magnetic proximity switch could be utilized.

Although certain preferred embodiments of the invention have been herein described in order to provide an understanding of the general principles of the invention, it will be appreciated that various changes and innovations can be affected in the described drilling apparatus without departing from these principles. For example, a fluid diverter switch mechanically connected to a pendulum and arranged to divert power fluid to one or the other of said power cylinder actuating controls could be provided. Another alternative would be the use of a rheostat connected to a pivoted or slidable weight on the mast structure with the rheostat directing actuating power to electric mast alignment motors operably attached to the mast structure. The invention is declared to cover all changes and modifications of the specific example of the invention herein disclosed for purposes of illustration, which do not constitute departures from the spirit and scope of the invention.

The embodiments of the invention in which an exclusive property or privilege is claimed are defined as follows:

1. An alignment system for a movable vertical structure having power movement systems thereon, said alignment system adapted to maintain said structure in a substantially exact vertical orientation with respect to the center of gravity of the earth, and comprising:

first lateral sensing means on the vertical structure, located in one plane of movement of said structure and arranged to sense the direction of movement of the structure vertical axis in a direction parallel to said one plane;

second lateral sensing means on the vertical structure, located in a second plane at substantially right angle orientation to said first plane of movement of the structure, said second sensing means arranged to sense the direction of movement of the structure vertical axis in a direction parallel to said second plane;

signal means operatively connected to said first and second sensing means and adapted to generate signals in response to activation of said sensing means, said signal means operatively connected to the power movement systems on the vertical structure; and wherein at least one of said first and second sensing means comprises strain gauge means attached at one end to movable means mounted on the vertical structure, said strain gauge means adapted to generate electrical signals in response to movement of said movable means on the vertical structure.

2. The alignment system of claim 1 further comprising damping means operably connected to at least one of said first and second sensing means arranged to damp oscillations within said sensing means.

3. The alignment system of claim 1 wherein at least one of said first and second sensing means comprises movable actuator means mounted on the vertical structure and a potentiometer operably connected to said actuator means and arranged to generate an electrical signal of intensity varying with the position of said actuator means on the veritical structure.

4. The alignment system of claim 1 wherein at least one of said first and second sensing means comprises:

movable means mounted on the vertical structure and arranged to move in response to vertical misalignment of the vertical structure;

air jet means on each side and spaced from said movable means, said air jet means arranged to direct a stream of air at said movable means; and, differential pressure determining means fluidically communicating with said air jet means and adapted to actuate said signal means in response to differential pressures in said air jet means.

5. The alignment system of claim 1 wherein at least one of said first and second sensing means comprises:

weighted means movably attached to the vertical structure and arranged to move in response to gravity in the direction of misalignment of the structure;

a double-acting dual element hydraulic assembly, said two elements comprising a piston and a cylinder, with one of said elements beng connected to said weighted means and the other of said elements being secured to the structure;

said hydraulic cylinder assembly containing said piston in sealing slidable arrangement therein and having pressure sensing means near each end thereof, said piston being surrounded by hydraulic fluid and having opposed pressure faces thereon; and, each said piston opposing pressure face arranged to individually communicate with one of said sensing means at one end of said cylinder.

* * * * *

UNITED STATES PATENT OFFICE
CERTIFICATE OF CORRECTION

Patent No. 4,022,284 Dated May 10, 1977

Inventor(s) Morgan LeVon Crow

It is certified that error appears in the above-identified patent and that said Letters Patent are hereby corrected as shown below:

In column 10, line 26, insert --movably-- immediately after "means".

Signed and Sealed this

*sixteenth* Day of *August 1977*

[SEAL]

*Attest:*

RUTH C. MASON
*Attesting Officer*

C. MARSHALL DANN
*Commissioner of Patents and Trademarks*